US008002459B2

(12) United States Patent
Robin

(10) Patent No.: US 8,002,459 B2
(45) Date of Patent: Aug. 23, 2011

(54) CHRONOGRAPH WATCH

(75) Inventor: Brice Robin, Renan (CH)

(73) Assignee: Omega S.A., Bienne (CH)

( * ) Notice: Subject to any disclaimer, the term of this patent is extended or adjusted under 35 U.S.C. 154(b) by 464 days.

(21) Appl. No.: 12/255,887

(22) Filed: Oct. 22, 2008

(65) Prior Publication Data

US 2009/0103398 A1 Apr. 23, 2009

(30) Foreign Application Priority Data

Oct. 22, 2007 (EP) ..... 07119001

(51) Int. Cl.
*G04F 7/00* (2006.01)

(52) U.S. Cl. ..... 368/101

(58) Field of Classification Search ..... 368/80, 368/101–106, 110, 113, 220
See application file for complete search history.

(56) References Cited

U.S. PATENT DOCUMENTS 3,842,591 A * 10/1974 Dubois et al. ..... 368/104
5,253,231 A * 10/1993 Vuilleumier ..... 368/322
6,428,201 B1 * 8/2002 Shibuya et al. ..... 368/106
6,724,692 B1 * 4/2004 Akahane et al. ..... 368/204
2004/0264304 A1 * 12/2004 Furukawa et al. ..... 368/223

FOREIGN PATENT DOCUMENTS

| | | |
|---|---|---|
| CH | 506 824 | 6/1971 |
| EP | 0 482 443 | 4/1992 |
| EP | 1 102 135 | 5/2001 |
| WO | 03/040835 A2 | 5/2003 |

OTHER PUBLICATIONS

European search report issued in corresponding application No. EP 07 11 9001, completed Jul. 10, 2008.

* cited by examiner

*Primary Examiner* — Vit W Miska
(74) *Attorney, Agent, or Firm* — Griffin & Szipl, P.C.

(57) ABSTRACT

A chronograph watch fitted with a going train including:
a permanent seconds wheel set secured to a permanent seconds display member,
a chronograph seconds wheel set cooperating with a coupling in order to be secured to a chronograph seconds display member, and a third wheel set including a first third wheel fixedly mounted in rotation, meshed either with the permanent seconds wheel set, or with the chronograph seconds wheel set, a second third wheel mounted to move freely, meshed with the permanent seconds wheel set and with the chronograph seconds wheel set.

5 Claims, 2 Drawing Sheets

CHRONOGRAPH WATCH

This application claims priority from European Patent Application No. 07119001.1, filed Oct. 22, 2007, the entire disclosure of which is incorporated herein by reference.

FIELD OF THE INVENTION

The present invention relates to the field of horology. It concerns more specifically a chronograph watch fitted with a permanent seconds counter and a chronograph seconds counter.

BACKGROUND OF THE INVENTION

This type of chronograph watch conventionally includes a going train forming an energy transmission chain from an energy accumulator member, the barrel, to an energy distributor member, the escapement. This going train is generally formed of a centre wheel set, a third wheel set, and a chronograph seconds wheel set mounted in series between the barrel and the escapement. It further includes a permanent seconds wheel, secured to a permanent seconds display member, mounted in shunt from the third wheel set. Thus mounted, the permanent seconds wheel set is located at the end of gear train formed of the centre wheel set, the third wheel set and the permanent seconds wheel set.

Because of its location at the end of a gear train, the permanent seconds wheel set may rotate in an irregular jerky manner, which gives the permanent seconds display member a fluttering, imprecise appearance. This problem, well known to those skilled in the art, arises from the existence of a backlash, i.e. an angular play between the various wheel sets, provided for reasons of manufacturing tolerances, on the one hand, and in order to avoid a situation in which the gears are blocked, on the other hand. At the heart of a gear, the backlash is compensated for from one wheel set to another by the braking action exerted by the next wheel set, but at the end of the gear, as is the case of the permanent seconds wheel set, this braking action is non-existent and the backlash reverberates fully.

One solution for overcoming this problem consists in providing the permanent seconds wheel set with a friction device exerting axial friction able to suppress the random angular movements linked to backlash. EP Patent No 0 482 443 and CH Patent No 506 824 disclose devices of this type. It will be noted, however, that this type of solution is unfavourable from the point of view of energy consumption, because of waste generated by the friction.

The present invention proposes an alternative solution to the problem of fluttering of the permanent seconds display member that does not rely on a friction device and does not involve wasting energy. More specifically, the invention concerns a chronograph watch fitted with a going train, including:

- a permanent seconds wheel set secured to a permanent seconds display member,
- a chronograph seconds display wheel set cooperating with a coupling device in order to be connected to a chronograph seconds display member, and
- a third wheel set including a first third wheel secured in rotation, meshed either with the permanent seconds wheel set or with said chronograph seconds wheel set.

SUMMARY OF THE INVENTION

According to the invention, the going train further includes a second third wheel arranged to move freely, meshed, on the one hand with the permanent seconds wheel set, and on the other hand with the chronograph seconds wheel set.

Thanks to the second third wheel, arranged to move freely between the permanent seconds wheel set and the chronograph seconds wheel set, the permanent seconds wheel set is no longer located at the end of the gear. Thus, it is no longer subjected to random angular movements linked to the backlast and the fluttering appearance of the permanent seconds display member is eliminated but in series with the going train.

BRIEF DESCRIPTION OF THE DRAWINGS

Other features and advantages of the present invention will appear more clearly upon reading the following detailed description of a chronograph watch according to the invention, this example being given purely by way of non-limiting example, with reference to the annexed drawing, in which.

DETAILED DESCRIPTION OF THE ILLUSTRATIVE EMBODIMENTS

Figure 1:
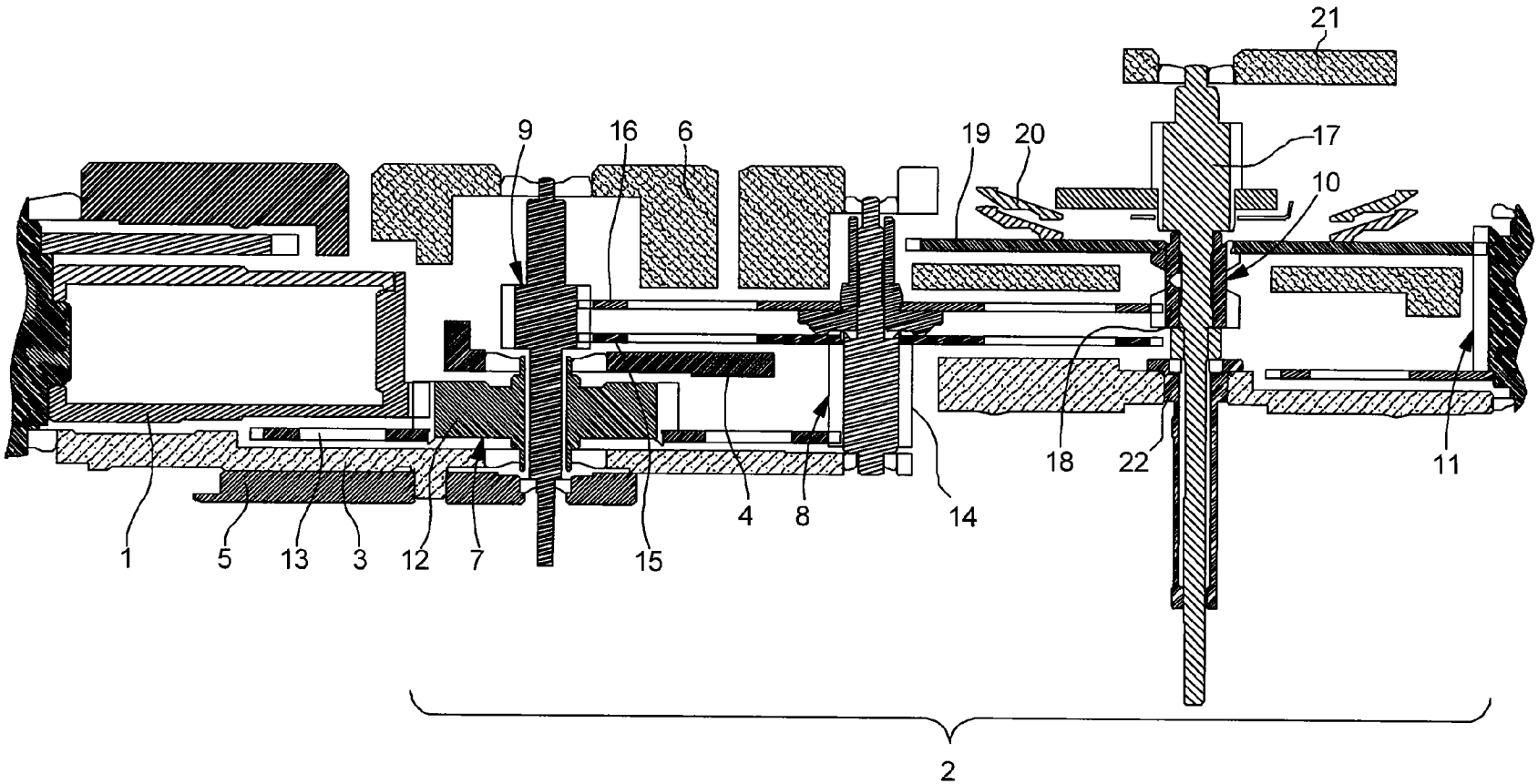
FIGS. 1 and 2 are respectively partial cross-sectional and partial top views of the chronograph watch according to the invention.
Figure 2:
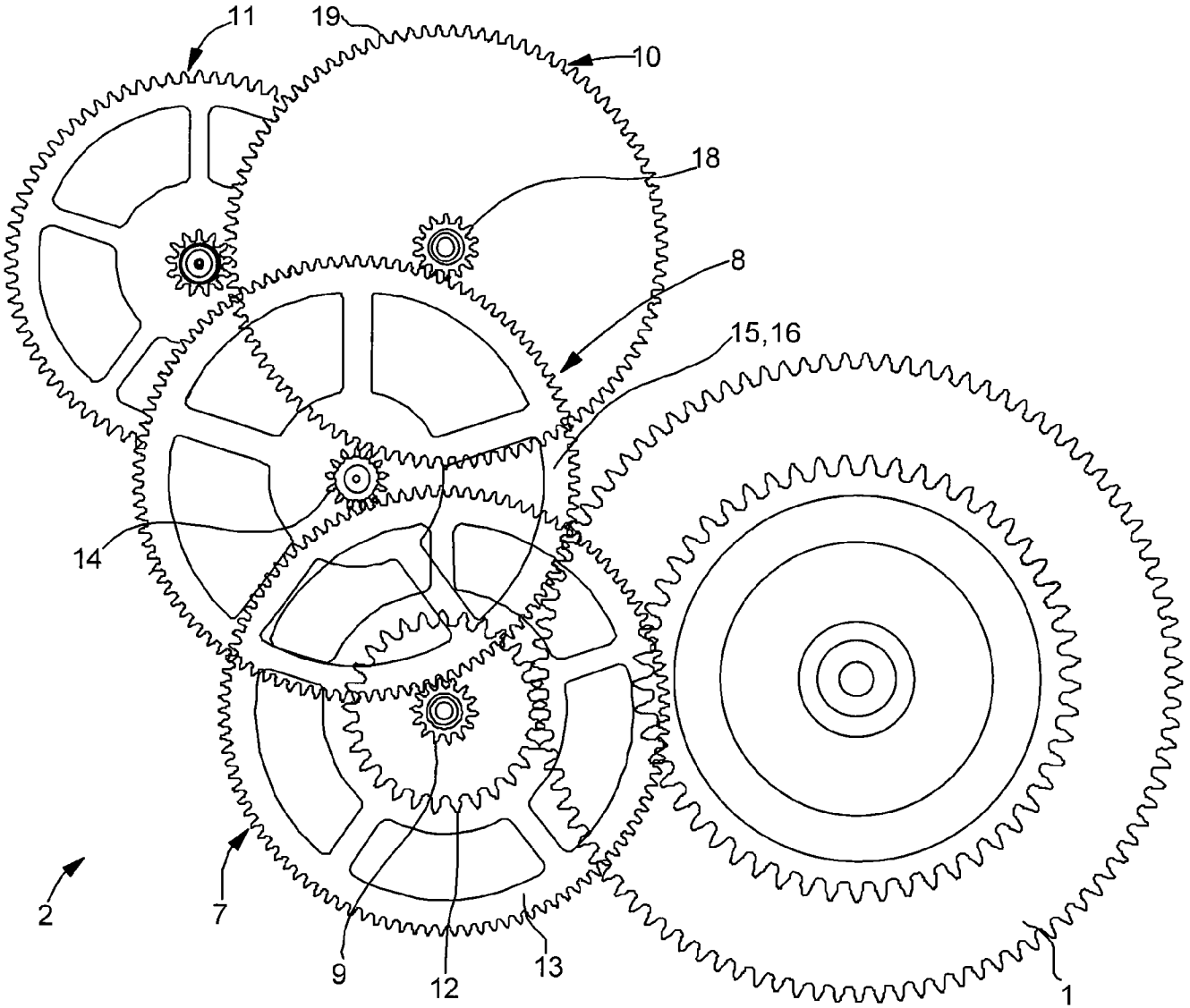

The chronograph watch shown in FIGS. 1 and 2 include in a conventional manner an energy accumulator member, the barrel 1, and a going train 2, for transmitting the energy from barrel 1 to a distribution member (not shown). The assembly is mounted between a plate 3, a centre wheel set bridge 4, a permanent seconds bridge 5 and a gear train bridge 6. Going train 2 includes, mounted in series from barrel 1, a centre wheel set 7, a third wheel set 8, an off-centre permanent seconds wheel set 9 secured in rotation to a permanent seconds display member that is not shown, a central chronograph seconds wheel set 10 and an intermediate escapement wheel set 11.

The centre wheel set 7 is formed of a centre pinion 12 meshed with barrel 1, and a centre wheel 13 secured in rotation to centre pinion 12. The centre wheel set is mounted between plate 3 and third wheel bridge 4. Centre wheel 13 drives in rotation third wheel set 8, which is mounted between plate 3 and gear train bridge 6, and includes a third pinion 14, and a first third wheel 15, secured in rotation to third pinion 14. To thus end, the centre wheel 13 meshes with the third pinion 14. The first third wheel 15 is also meshed with permanent seconds wheel set 9, mounted between the permanent seconds bridge 5 and gear train bridge 6, and formed of a pinion.

According to the invention, third wheel set 8 further includes a second third wheel 16, mounted to move freely, meshed with permanent seconds wheel set 9. The second third wheel 16 also drives chronograph seconds wheel set 10, mounted to rotate freely on a chronograph seconds counter wheel set 17, and formed of a chronograph seconds pinion 18 and a chronograph seconds wheel 19, secured in rotation to pinion 18. Thus, the second third wheel 16 is meshed with chronograph seconds pinion 18.

Finally, chronograph seconds wheel 19 meshes with intermediate escape wheel 11, which is itself meshed with a distribution member (not shown).

The transmission of energy within going train 2 described above, from barrel 1 to the distribution member that is not shown, occurs by passing through centre pinion 12, centre wheel 13, third pinion 14, first third wheel 15, permanent seconds wheel set 9, second third wheel 16, chronograph seconds pinion 18, chronograph seconds wheel 19 and finally intermediate escape wheel 11.

Owing to the presence of second third wheel 16 on the third wheel set, the permanent seconds wheel set 9 is not longer located at the end of the gear, but in series in going train 2. The backlash to which it is subjected is thus reduced by the braking exerted by the second third wheel 16, and the impression of jerkiness given by the permanent seconds display member is removed.

It will be noted that, in order to obtain the same rotational speed for permanent seconds wheel set 9 and chronograph seconds wheel set 10, the diameter and number of teeth of second third wheel 16 have to be identical to first third wheel 15. It is clear that, as in a conventional embodiment, the following conditions must also be respected: the diameter and number of teeth of the pinion of permanent seconds wheel set 9 and pinion 18 of chronograph seconds wheel set 10 must be identical, and the distance between third wheel set 8 axis and permanent seconds wheel set 9 axis is equal to the distance between third wheel set 8 axis and chronograph seconds wheel set 10 axis.

It will also be noted that the chronograph seconds wheel set 10 is mounted to rotate freely on a chronograph seconds counter wheel set 17, secured to a chronograph seconds display member that is not shown. A vertical coupling device 20, arranged between the chronograph seconds wheel set and the chronograph seconds counter wheel set 17 secures these two wheel sets to each other in rotation when the chronograph is switched on. Chronograph seconds counter wheel set 17 is mounted to rotate freely between a chronograph bridge 17 is mounted to rotate freely between a chronograph bridge 21 and a centre tube 22 driven into plate 3. This assembly is well known to those skilled in the art and will not be described in more detail.

We have thus described a chronograph watch whose permanent seconds display member is free of any problem of jerkiness. It goes without saying that the present invention is not limited to the embodiment that has just been described and that various simple alterations and variants could be envisaged by those skilled in the art without departing from the scope of the present invention defined by the annexed claims.

It will be noted in particular that the embodiment of the chronograph watch that has just been described, is particularly advantageous because of its compactness. However, in a first variant of this embodiment, the second third wheel 16 could be mounted on an intermediate wheel that is distinct from the third wheel set, located between the permanent seconds wheel set 9 and chronograph seconds wheel set 10, provided that the aforecited condition as to distances between their respective axis is observed. In this particular case, third wheel set 8 would only include a first third wheel 15 and would therefore not be subjected to the above mentioned conditions on the distance between the axes. This embodiment is equivalent to the previously described embodiment from an operational point of view, but it requires more space.

It will also be noted that in a second simple variant of the embodiment described, the first third wheel 15 could be meshed with the chronograph seconds wheel set 10 rather than with the permanent seconds wheel set 9. The arrangement of the second third wheel 16, however, remains unchanged. In this embodiment, chronograph seconds wheel set 10 is formed of only one pinion, whereas permanent seconds wheel set 9 includes one pinion and one wheel, said wheel meshing with the intermediate escape wheel set 11. The transmission of energy in going train 2 thus described, from barrel 1 to the distribution member that is not shown, occurs by passing through the centre pinion 12, centre wheel 13, third pinion 14, first third wheel 15, chronograph seconds pinion 18, second third wheel 16, permanent seconds wheel set 9 and finally intermediate escape wheel set 11. This embodiment is equivalent, from the point of view of operation, to the previously described embodiment.

What is claimed is:

1. A chronograph watch fitted with a going train including:

a permanent seconds wheel set secured to a permanent seconds display member, a chronograph seconds wheel set cooperating with a coupling in order to be secured to a chronograph seconds display member, and a third wheel set including a first third wheel fixedly mounted in rotation, meshed either with the permanent seconds wheel set, or with the chronograph seconds wheel set, wherein the going train further includes a second third wheel mounted to move freely, meshed with the permanent seconds wheel set and with the chronograph seconds wheel set.

2. The chronograph watch according to claim 1, wherein the diameter and number of teeth of said second third wheel are identical to the diameter and number of teeth of the first third wheel.

3. The chronograph watch according to claim 1, wherein the distance between the second third wheel axis and the permanent seconds wheel set axis is equal to the distance between the second third wheel axis and the chronograph seconds wheel set axis.

4. The chronograph watch according to claim 1, wherein said second third wheel is mounted on said third wheel set.

5. The chronograph watch according to claim 1, wherein the first third wheel is meshed with the permanent seconds wheel set.

* * * * *